US009464830B2

(12) United States Patent
Kanazawa et al.

(10) Patent No.: US 9,464,830 B2
(45) Date of Patent: Oct. 11, 2016

(54) REFRIGERATION APPARATUS FOR EXECUTING A PUMP DOWN

(71) Applicant: DAIKIN INDUSTRIES, LTD., Osaka-shi, Osaka (JP)

(72) Inventors: Yukako Kanazawa, Sakai (JP); Junichi Shimoda, Sakai (JP); Tatsuya Makino, Sakai (JP); Shouhei Miyatani, Sakai (JP); Toshihiko Takayama, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 14/364,627

(22) PCT Filed: Dec. 13, 2012

(86) PCT No.: PCT/JP2012/082322

§ 371 (c)(1),
(2) Date: Jun. 11, 2014

(87) PCT Pub. No.: WO2013/089179

PCT Pub. Date: Jun. 20, 2013

(65) Prior Publication Data

US 2014/0318165 A1 Oct. 30, 2014

(30) Foreign Application Priority Data

Dec. 13, 2011 (JP) ..... 2011-272756

(51) Int. Cl.
*F25B 39/04* (2006.01)
*F25B 30/02* (2006.01)
(Continued)

(52) U.S. Cl.
CPC ..... *F25B 30/02* (2013.01); *F25B 39/00* (2013.01); *F25B 13/00* (2013.01); *F25B 2400/19* (2013.01);
(Continued)

(58) Field of Classification Search
CPC F25B 2400/19; F25B 2500/01; F25B 13/00; F25B 39/00; F28D 1/05391; F28D 2021/0068; F28F 2215/12
USPC ..... 62/238.6
See application file for complete search history.

(56) References Cited

U.S. PATENT DOCUMENTS 4,045,977 A * 9/1977 Oliver, Jr. ..... F25B 13/00 62/324.4
6,148,632 A * 11/2000 Kishita et al. ..... 62/323.1
(Continued)

FOREIGN PATENT DOCUMENTS

JP 6-143991 A 5/1994
JP 2001-248938 A 9/2001
(Continued)

OTHER PUBLICATIONS

Australian Office Action of corresponding Australian Application No. 2012353397 dated Jul. 23, 2014.
(Continued)

*Primary Examiner* — Marc Norman
*Assistant Examiner* — Ana Vazquez
(74) *Attorney, Agent, or Firm* — Global IP Counselors

(57) ABSTRACT

An air-conditioning apparatus includes an outdoor unit, an indoor unit having an indoor heat exchanger, and a controller for executing a pump down operation. The outdoor unit has an accumulator of a capacity (Va), a compressor, an outdoor heat exchanger, an expansion valve, a large-diameter tube, which are joined by refrigerant pipes. The capacity (Vhi) of the indoor heat exchanger is greater than the capacity (Vho) of the outdoor heat exchanger. The large-diameter tube, which is larger in diameter than the refrigerant pipes, is provided so that the capacity (Vt) of the large-diameter tube satisfies the formula: capacity (Vt)>capacity (Vhi)−capacity (Vho)−capacity (Va).

6 Claims, 9 Drawing Sheets

(51) Int. Cl.

| | |
|---|---|
| ***F25B 39/00*** | (2006.01) |
| *F25B 13/00* | (2006.01) |
| *F28D 1/053* | (2006.01) |
| *F28D 21/00* | (2006.01) |

(52) U.S. Cl.
CPC ..... *F25B 2500/01* (2013.01); *F28D 1/05391* (2013.01); *F28D 2021/0068* (2013.01); *F28F 2215/12* (2013.01)

(56) References Cited

U.S. PATENT DOCUMENTS

2008/0053120 A1* 3/2008 Nakai ..... F25B 13/00 62/157
2009/0173478 A1* 7/2009 Beamer et al. ..... 165/151
2010/0037642 A1* 2/2010 Shimoda et al. ..... 62/228.1
2012/0144852 A1* 6/2012 Wakuta ..... F25B 13/00 62/157

FOREIGN PATENT DOCUMENTS

JP 2002-295915 A 9/2002
JP 2004-271110 A 9/2004
JP 2009-210143 A 9/2009
JP 2009-299961 A 12/2009

OTHER PUBLICATIONS

International Preliminary Report of corresponding PCT Application No. PCT/JP2012/082322.
International Search Report of corresponding PCT Application No. PCT/JP2012/082322.
European Search Report of corresponding EP Application No. 12 85 8504.9 dated Sep. 7, 2015.

* cited by examiner

REFRIGERATION APPARATUS FOR EXECUTING A PUMP DOWN

TECHNICAL FIELD

The present invention relates to a refrigeration apparatus.

CROSS-REFERENCE TO RELATED APPLICATIONS

This U.S. National stage application claims priority under 35 U.S.C. §119(a) to Japanese Patent Application No. 2011-272756, filed in Japan on Dec. 13, 2011, the entire contents of which are hereby incorporated herein by reference.

BACKGROUND ART

In refrigeration apparatuses such as air-conditioning apparatuses, there is often a difference between the optimal refrigerant quantity for an air-cooling operation and the optimal refrigerant quantity for an air-warming operation, and there is also often a difference between the capacity of a heat source-side heat exchanger functioning as a heat radiator of refrigerant during the air-cooling operation and the capacity of a usage-side heat exchanger functioning as a heat radiator of refrigerant during the air-warming operation. In a conventional refrigeration apparatus, the capacity of the heat source-side heat exchanger is often greater than the capacity of the usage-side heat exchanger, and refrigerant that cannot be accommodated by the usage-side heat exchanger during the air-warming operation is temporarily stored in an accumulator or the like.

Recently there are small high-performance heat exchangers such as the one presented in Japanese Laid-open Patent Application No. 6-143991.

SUMMARY

Technical Problem

When this type of small heat exchanger is used as a heat source-side heat exchanger of a refrigeration apparatus, the capacity of the heat source-side heat exchanger is less than the capacity of the usage-side heat exchanger, opposite of a conventional refrigeration apparatus, and during a pump down operation of actuating the refrigeration apparatus in an air-cooling operation cycle, there is a risk of circumstances arising such that refrigerant cannot be accommodated in the heat source-side unit.

An object of the present invention is to provide a refrigeration apparatus in which refrigerant can be suitably collected in the heat source-side unit by a pump down operation even when the capacity of the usage-side heat exchanger is greater than the capacity of the heat source-side heat exchanger.

Solution to Problem

A refrigeration apparatus according to a first aspect of the present invention comprises a heat source-side unit, a usage-side unit, and a controller. The heat source-side unit has a refrigerant container, a compressor, a heat source-side heat exchanger, an expansion valve, a large-diameter tube, a liquid refrigerant-side shutoff valve, and a gas refrigerant-side shutoff valve, which are joined together by refrigerant pipes. The usage-side unit has a usage-side heat exchanger. The usage-side heat exchanger is joined at one end to the liquid refrigerant-side shutoff valve via a liquid refrigerant communication pipe, and is joined at the other end to the gas refrigerant-side shutoff valve via a gas refrigerant communication pipe. The controller executes a pump down operation for collecting refrigerant in the heat source-side unit. The capacity of the refrigerant container is a capacity Va. The capacity of the heat source-side heat exchanger is a capacity Vho. The capacity of the usage-side heat exchanger is a capacity Vhi, which is greater than the capacity Vho. The large-diameter tube is a tube of larger diameter than the refrigerant pipes of the heat source-side unit. The large-diameter tube is provided so that the capacity Vt, which is the capacity of the large-diameter tube, satisfies the formula:

$$\text{capacity } Vt > \text{capacity } Vhi - \text{capacity } Vho - \text{capacity } Va > 0.$$

The large-diameter tube is provided between the heat source-side heat exchanger and the liquid refrigerant-side shutoff valve.

When the capacity Vhi of the usage-side heat exchanger is greater than the capacity Vho of the heat source-side heat exchanger, there is a risk that the capacity of the refrigerant circuit of the heat source-side unit will be insufficient even if the pump down operation is performed for collecting refrigerant in the heat source-side unit. However, in the refrigeration apparatus according to the present invention, because the heat source-side unit has not only the refrigerant container of capacity Va and the heat source-side heat exchanger of capacity Vho but also the large-diameter tube of capacity Vt which is larger in diameter than the refrigerant pipes, it is possible for refrigerant to be accumulated in the large-diameter tube as well during the pump down operation, and refrigerant is collected in the heat source-side unit. The failure of refrigerant to be collected in the heat source-side unit is suppressed herein, and the capacity Vt of the large-diameter tube is therefore greater than the capacity resulting from subtracting the capacity Vho of the heat source-side heat exchanger and the capacity Va of the refrigerant container from the capacity Vhi of the usage-side heat exchanger. Refrigerant can thereby be suitably collected in the heat source-side unit by the pump down operation.

A refrigeration apparatus according to a second aspect of the present invention is the refrigeration apparatus according to the first aspect, wherein the heat source-side heat exchanger is a stacked heat exchanger. The heat source-side heat exchanger also has a plurality of flat tubes and heat transfer fins. The plurality of flat tubes is arrayed at intervals. The heat transfer fins are in contact with the flat tubes.

The capacity of a stacked heat exchanger is less than the capacity of a cross-fin heat exchanger having a similar heat exchange performance. In a refrigeration apparatus in which both the heat source-side heat exchanger and the usage-side heat exchanger are cross-fin heat exchangers, for example, when only the heat source-side heat exchanger is replaced with a stacked heat exchanger having a similar heat exchange performance, the capacity of the stacked heat exchanger is not only less than the capacity of the cross-fin heat source-side heat exchanger, but is also less than the capacity of the cross-fin usage-side heat exchanger connected to the stacked heat source-side heat exchanger.

In the refrigeration apparatus according to the second aspect of the present invention, a stacked heat exchanger is used as the heat source-side heat exchanger, and the capacity Vhi of the usage-side heat exchanger is greater than the capacity Vho of the heat source-side heat exchanger, but because the heat source-side unit is equipped with a large-diameter tube ensured to have a predetermined capacity Vt, refrigerant can be sufficiently collected in the heat source-side unit by the pump down operation.

A refrigeration apparatus according to a third aspect of the present invention is the refrigeration apparatus according to the first or second aspect, wherein the refrigerant container is equipped with a gas-liquid separation function. The large-diameter tube is not equipped with a gas-liquid separation function.

The refrigerant container, which is the same type provided to conventional refrigeration apparatuses, is made to have a gas-liquid separation function similar to that of conventional practice, while the large-diameter tube is not equipped with a gas-liquid separation function to reduce cost increases. Therefore, the refrigeration apparatus according to the present invention can be manufactured at comparatively low cost.

A refrigeration apparatus according to a fourth aspect of the present invention is the refrigeration apparatus according to any one of the first through third aspects, wherein the large-diameter tube is set up so that refrigerant flows from the top downward in the pump down operation.

Because refrigerant flows from the top in the large-diameter tube during the pump down operation, refrigerant accumulates readily in the space inside the large-diameter tube.

A refrigeration apparatus according to a fifth aspect of the present invention is the refrigeration apparatus according to any one of the first through fourth aspects, wherein the expansion valve is an electric valve disposed between the heat source-side heat exchanger and the liquid refrigerant-side shutoff valve. The large-diameter tube is disposed between the heat source-side heat exchanger and the expansion valve.

Because the large-diameter tube is disposed between the heat source-side heat exchanger and the expansion valve, the expansion valve can be put in a closed state by control to cause refrigerant to start accumulating in the large-diameter tube and the heat source-side heat exchanger before the liquid refrigerant-side shutoff valve is closed.

A refrigeration apparatus according to a sixth aspect of the present invention is the refrigeration apparatus according to any one of the first through fifth aspects, wherein the refrigerant container is an accumulator provided to the refrigerant pipe on the intake side of the compressor. The controller executes a first liquid accumulation step before a second liquid accumulation step in the pump down operation. In the first liquid accumulation step, the liquid refrigerant-side shutoff valve is opened and humid gas refrigerant is drawn out of the usage-side heat exchanger via the gas refrigerant communication pipe, causing refrigerant to accumulate in the refrigerant container. In the second liquid accumulation step, the liquid refrigerant-side shutoff valve is closed and refrigerant is sent from the compressor to the heat source-side heat exchanger, causing refrigerant to accumulate in the large-diameter tube and the heat source-side heat exchanger.

When refrigerant is collected in the heat source-side unit by the pump down operation, in conventional practice, the liquid refrigerant-side shutoff valve would be closed and the refrigerant would be sent from the compressor to the heat source-side heat exchanger. Therefore, the refrigerant would accumulate in the heat source-side heat exchanger but the refrigerant would for the most part not accumulate in the accumulator provided to the intake-side pipe of the compressor.

In view of this, in the refrigeration apparatus according to the sixth aspect of the present invention, the first liquid accumulation step for accumulating refrigerant in the accumulator is performed before the second liquid accumulation step which is performed with the liquid refrigerant-side shutoff valve in a closed state. Thus, in the pump down operation, refrigerant is caused to accumulate in the different parts of the heat source-side unit sequentially in the first liquid accumulation step in which the liquid refrigerant-side shutoff valve is opened and humid gas refrigerant is drawn out of the usage-side heat exchanger, and the second liquid accumulation step in which the liquid refrigerant-side shutoff valve is closed and refrigerant is sent to the heat source-side heat exchanger. Therefore, in this refrigeration apparatus, it is possible to avoid circumstances in which refrigerant cannot be accommodated in the heat source-side unit.

Advantageous Effects of Invention

In the refrigeration apparatus according to the first and second aspects of the present invention, the capacity Vhi of the usage-side heat exchanger is greater than the capacity Vho of the heat source-side heat exchanger, but because the heat source-side unit is equipped with a large-diameter tube ensured to have a predetermined capacity Vt, refrigerant can be sufficiently collected in the heat source-side unit by the pump down operation.

In the refrigeration apparatus according to the third aspect of the present invention, the large-diameter tube is not equipped with a gas-liquid separation function to minimize cost increases, and the refrigeration apparatus according to the present invention can therefore be manufactured at comparatively low cost.

In the refrigeration apparatus according to the fourth aspect of the present invention, because refrigerant flows from the top in the large-diameter tube during the pump down operation, refrigerant accumulates readily in the space inside the large-diameter tube.

In the refrigeration apparatus according to the fifth aspect of the present invention, the expansion valve can be put in a closed state by control to cause refrigerant to accumulate in the large-diameter tube and the heat source-side heat exchanger.

In the refrigeration apparatus according to the sixth aspect of the present invention, because the accumulator of the heat source-side unit is effectively utilized, it is possible to avoid the failure of refrigerant not being collected in the heat source-side unit by the pump down operation.

DESCRIPTION OF EMBODIMENTS

An embodiment of the present invention is described below with reference to the drawings. The following embodiment is one specific example of the present invention and is not intended to limit the technical scope of the present invention.

(1) Configuration of Air-Conditioning Apparatus (1-1) Overall Configuration

Figure 1:
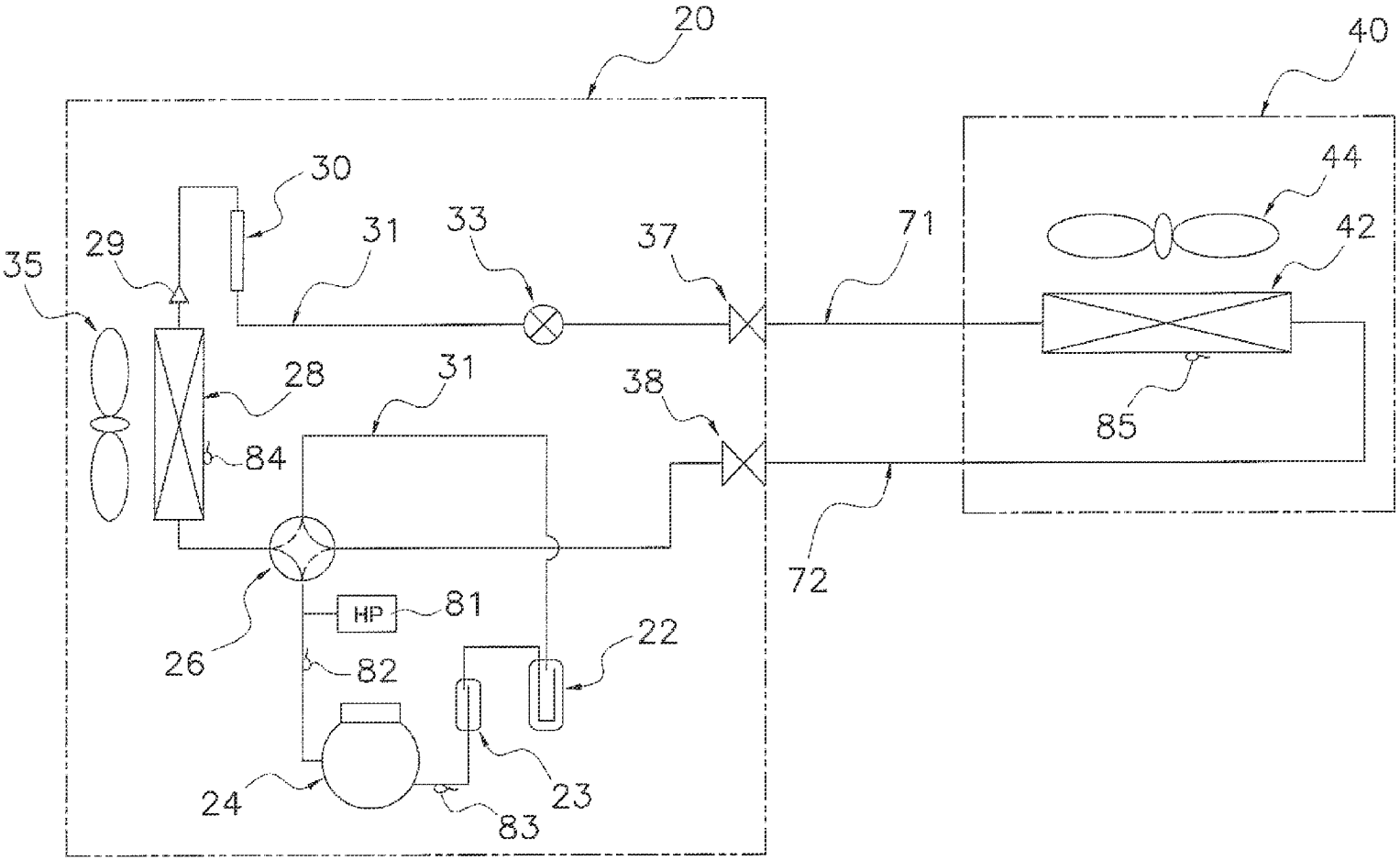
FIG. 1 is a refrigerant circuit diagram of an air-conditioning apparatus according to one embodiment of the present invention.

FIG. 1 is a drawing showing a refrigerant circuit diagram of an air-conditioning apparatus, which is the refrigeration apparatus according to one embodiment of the present invention. In FIG. 1, the air-conditioning apparatus is an air-conditioning apparatus capable of an air-cooling operation and an air-warming operation, comprising an outdoor unit 20, an indoor unit 40, and a liquid refrigerant communication pipe 71 and a gas refrigerant communication pipe 72 for connecting the outdoor unit 20 and the indoor unit 40. The various devices of the air-conditioning apparatus are controlled by a controller 80 (see FIG. 6).

(1-2) Indoor Unit

The indoor unit 40 has an indoor heat exchanger 42 and an indoor fan 44. The indoor heat exchanger 42 is a cross-fin heat exchanger, and is capable of evaporating or condensing refrigerant flowing through the interior by heat exchange with indoor air, and of cooling or heating the indoor air.

(1-2-1) Indoor Heat Exchanger

The indoor heat exchanger 42 has a capacity Vhi, and comprises heat transfer fins and heat transfer tubes. The heat transfer fins are flat plates made of thin aluminum, one heat transfer fin having a plurality of through-holes formed therein. The heat transfer tubes are composed of cylindrical straight tubes inserted through the through-holes of the heat transfer fins and U-shaped tubes linking ends of adjacent straight tubes together, the total capacity being a capacity Vhi. After being inserted into the through-holes of the heat transfer fins, the straight tubes are expanded by a tube expander, and are bonded firmly to the heat transfer fins.

(1-2-2) Indoor Fan

The indoor fan 44 draws in indoor air and blows the air to the indoor heat exchanger 42 by rotating, promoting heat exchange between the indoor heat exchanger 42 and the indoor air.

(1-3) Outdoor Unit

In FIG. 1, the outdoor unit 20 has primarily an accumulator 22, a compressor-designated container 23, a compressor 24, a four-way switching valve 26, an outdoor heat exchanger 28, a large-diameter tube 30, an expansion valve 33, a liquid refrigerant-side shutoff valve 37, and a gas refrigerant-side shutoff valve 38, which are joined by outdoor unit refrigerant pipes 31. The outdoor unit 20 also has an outdoor fan 35.

(1-3-1) Compressor, Four-Way Switching Valve, and Accumulator

The compressor 24 takes in gas refrigerant via the compressor-designated container 23 and compresses the gas refrigerant. The accumulator 22 is disposed in front of the compressor 24.

The four-way switching valve 26 switches the direction of refrigerant flow during a switch between an air-cooling cycle and an air-warming cycle. During the air-cooling operation and the hereinafter-described pump down operation, the four-way switching valve 26 connects the refrigerant pipe on the discharge side of the compressor 24 and an inlet/outlet on the gas side of the outdoor heat exchanger 28, and also connects the refrigerant pipe on the intake side of the compressor 24 and the gas refrigerant-side shutoff valve 38. In other words, the air-cooling cycle state is in effect, which is shown by the solid lines within the four-way switching valve 26 in FIG. 1.

During the air-warming operation, the four-way switching valve 26 connects the refrigerant pipe on the discharge side of the compressor 24 and the gas refrigerant-side shutoff valve 38, and also connects the refrigerant pipe on the intake side of the compressor 24 and the inlet/outlet on the gas side of the outdoor heat exchanger 28. In other words, the air-warming cycle state is in effect, which is shown by the dashed lines within the four-way switching valve 26 in FIG. 1.

The accumulator 22, which is a container having a capacity Va, has a gas-liquid separation function for separating the refrigerant into a gas phase and a liquid phase. Refrigerant flowing into the accumulator 22 is separated into a liquid phase and gas phase, and the gas phase refrigerant collecting in the upper space flows out to the compressor 24.

(1-3-2) Outdoor Heat Exchanger

The outdoor heat exchanger 28 is a stacked heat exchanger having a capacity Vho, and is capable of condensing or evaporating refrigerant flowing through the interior by heat exchange with outdoor air. The outdoor fan 35, which is disposed so as to face the outdoor heat exchanger 28, draws in outdoor air and blows the air to the outdoor heat exchanger 28 by rotating, and promotes heat exchange between the outdoor heat exchanger 28 and the outdoor air.

Figure 2:
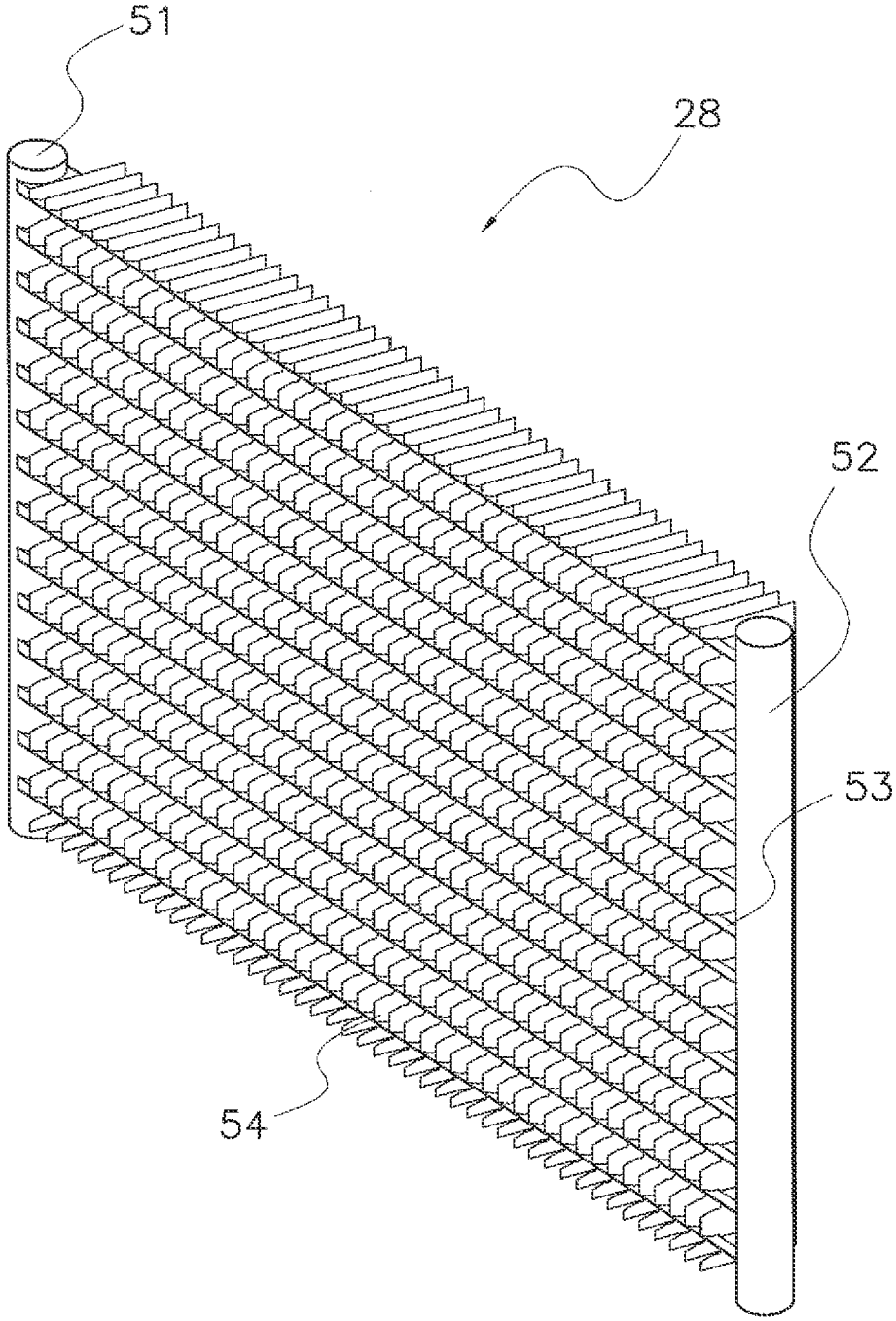
FIG. 2 is a perspective view of an outdoor heat exchanger.

FIG. 2 is an external perspective view of the outdoor heat exchanger 28. The outdoor heat exchanger 28 has flat perforated tubes 53, inserted fins 54, and headers 51, 52.

The flat perforated tubes 53, which are formed from aluminum or an aluminum alloy, have top and bottom flat surface parts as heat transfer surfaces, and a plurality of internal flow channels 53*a* (see FIG. 3) through which refrigerant flows. The flat perforated tubes 53 are arrayed at intervals in multiple levels with the flat surface parts facing up and down.

Figure 3:
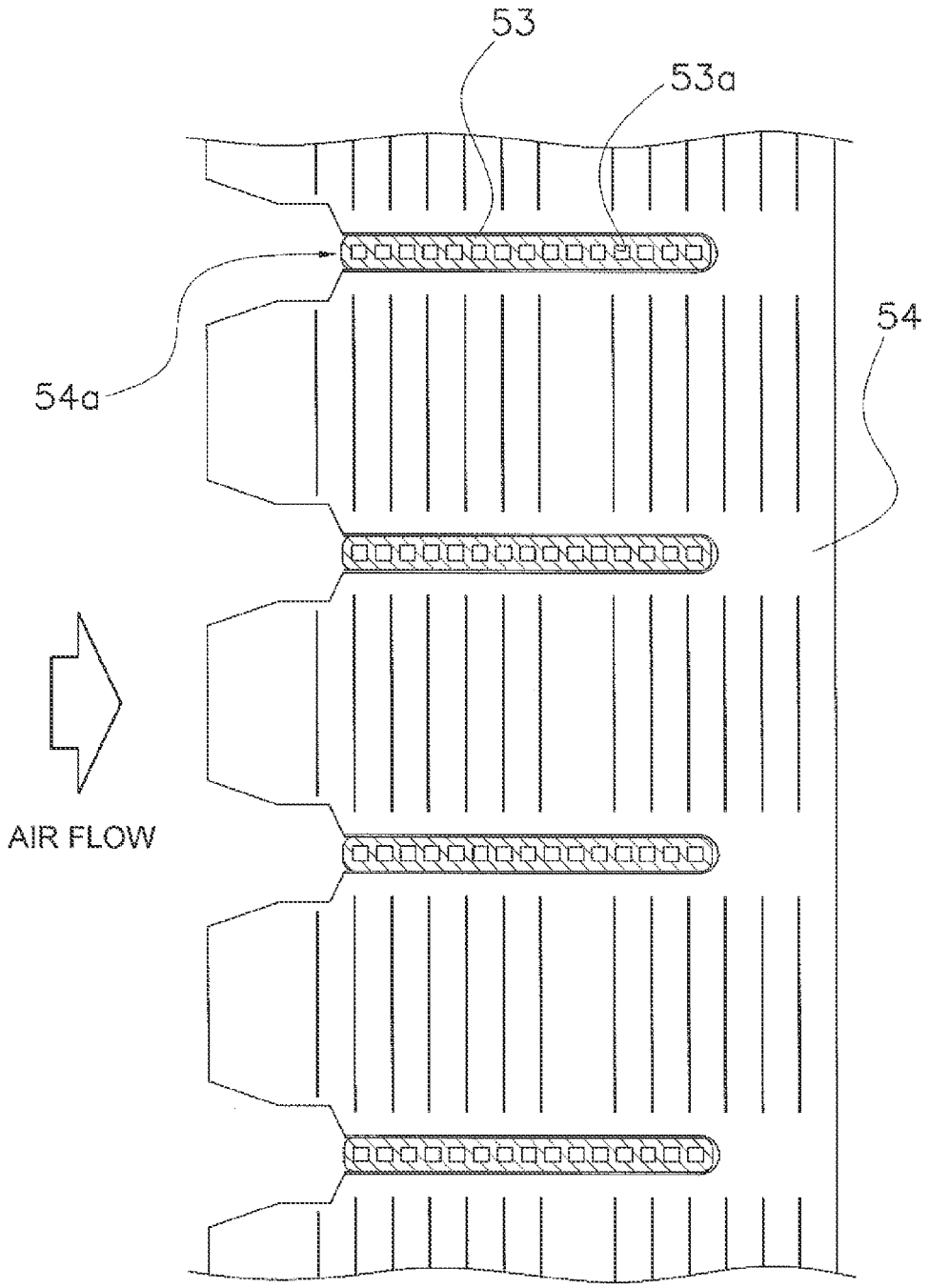
FIG. 3 is a longitudinal cross-sectional view of an outdoor heat exchanger.

The inserted fins 54 are fins made of aluminum or an aluminum alloy having the shape shown in FIG. 3, and are in contact with the flat perforated tubes 53. A plurality of long, thin notches 54*a* extending horizontally are formed in the inserted fins 54 so that the inserted fins 54 are inserted into the multiple levels of flat perforated tubes 53 arrayed between the headers 51, 52. The shapes of the notches 54*a* of these inserted fins 54 substantially coincide with the cross-sectional outlines of the flat perforated tubes 53, as shown in FIG. 3.

Figure 4:
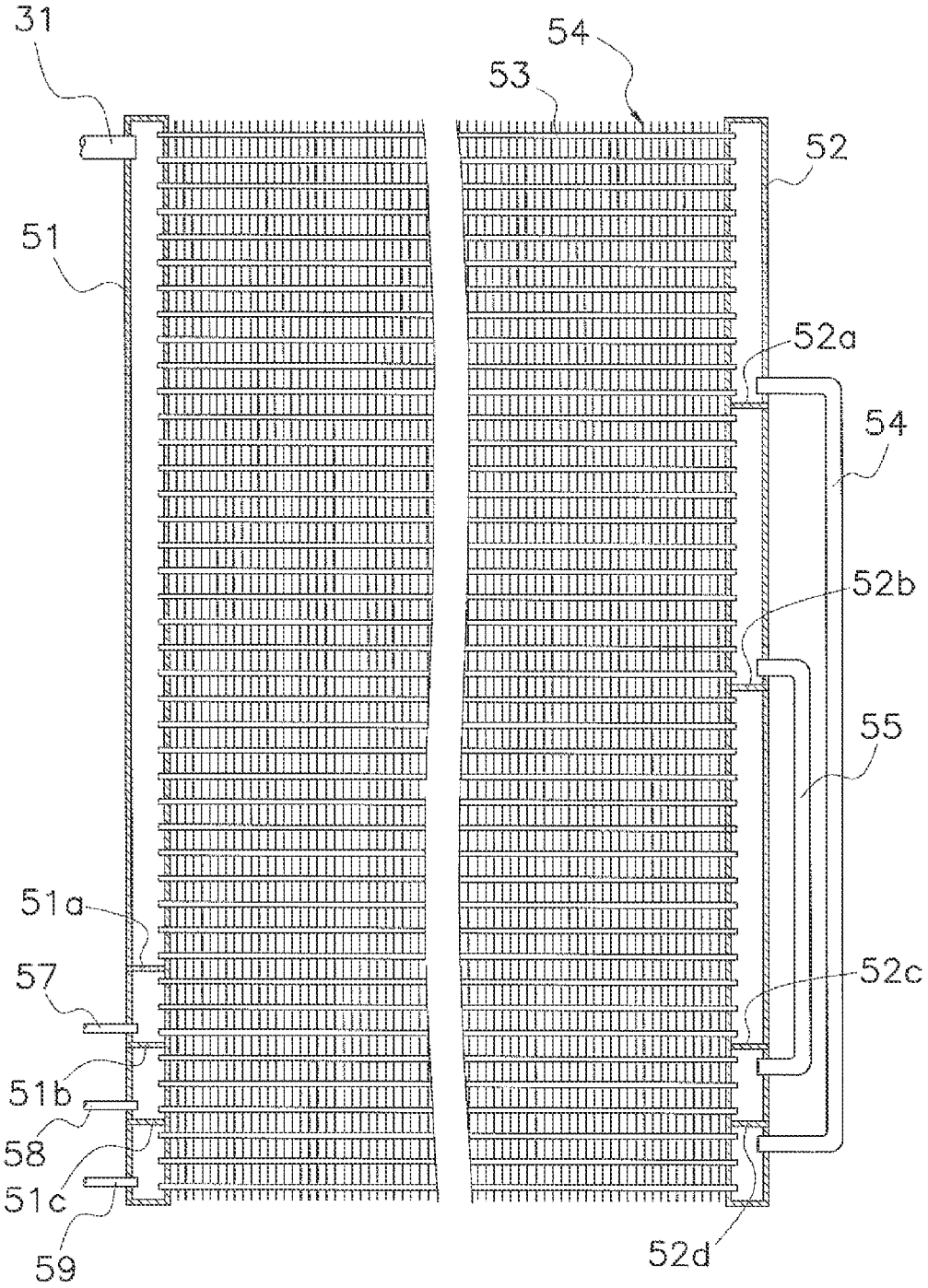
FIG. 4 is a drawing showing the refrigerant path in the outdoor heat exchanger.

The headers 51, 52 are linked to both ends of each of the flat perforated tubes 53, which are arrayed in multiple vertical levels. The headers 51, 52 have the function of supporting the flat perforated tubes 53, the function of leading refrigerant to the internal flow channels 53*a* of the flat perforated tubes 53, and the function of collecting refrigerant coming out of the internal flow channels 53*a*. The internal space of the header 51 is partitioned into four parts by partitioning plates 51*a*, 51*b*, 51*c*. The internal space of the header 52 is partitioned into five parts by partitioning plates 52*a*, 52*b*, 52*c*, 52*d*. Other than the flat perforated tubes 53, also connected to the internal spaces inside the headers 51, 52 are communication pipes 54, 55 shown in FIGS. 4 and 5, narrow tubes 57, 58, 59 extending from a flow diverter 29, and the outdoor unit refrigerant pipes 31.

The capacity Vho of the outdoor heat exchanger 28, which is the sum of the internal capacity of the flat perforated tubes 53 and the internal capacity of the headers 51, 52, is less than the capacity Vhi of the indoor heat exchanger 42. Conversely, the capacity Vhi of the indoor heat exchanger 42 is greater than the capacity Vho of the outdoor heat exchanger 28.

Figure 5:
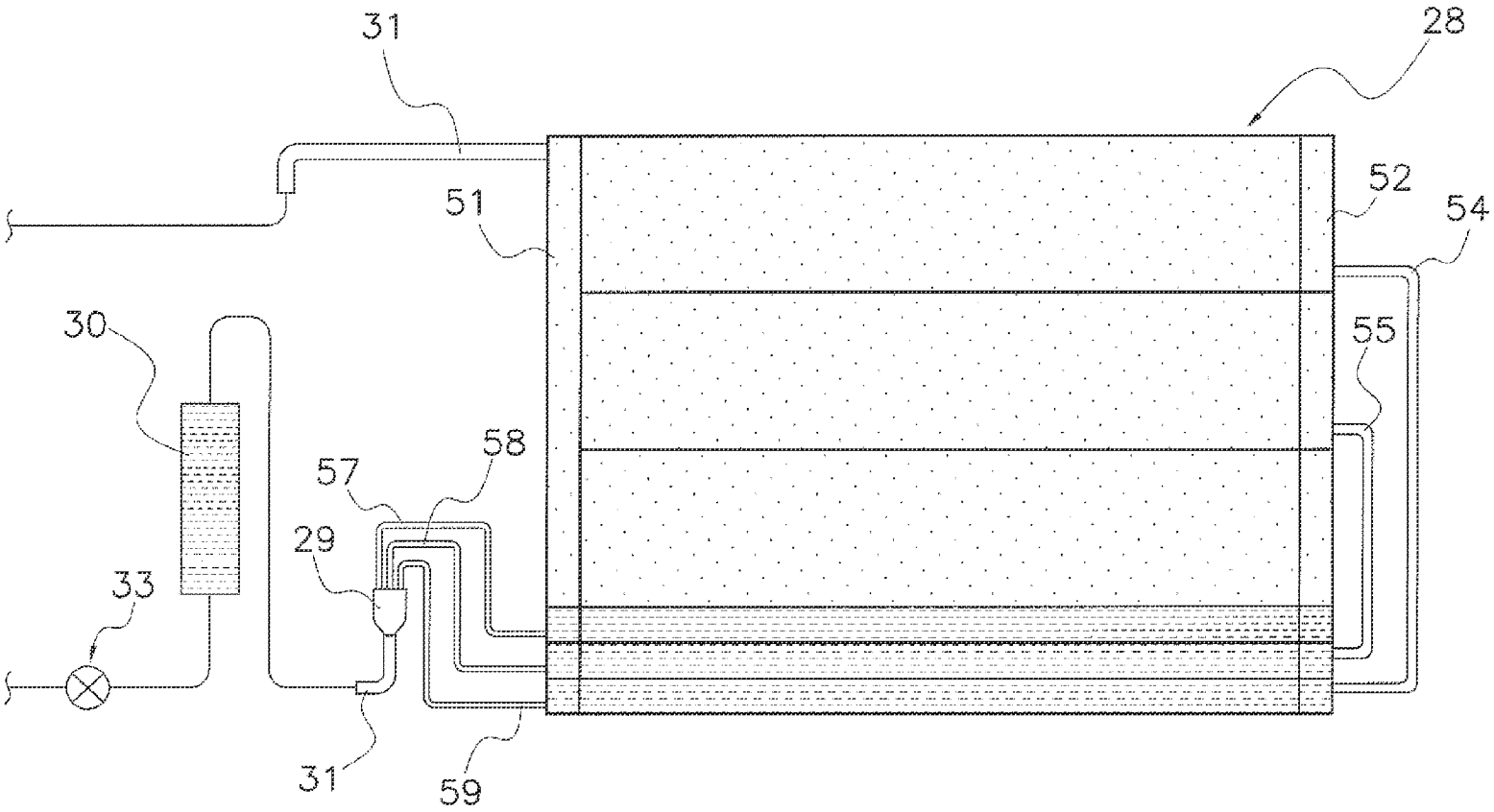
FIG. 5 is a drawing showing one state when liquid refrigerant is accumulated in the outdoor heat exchanger and the large-diameter tube in the second liquid accumulation step.

High-pressure gas refrigerant flowing out from the compressor 24 during the air-cooling cycle operation flows into the upper space of the header 51 via an outdoor unit refrigerant pipe 31, as shown in FIG. 5. This gas refrigerant flows through the flat perforated tubes 53 to the upper three of the five internal spaces of the header 52, turns back through each of these spaces, and flows through the lower disposed flat perforated tubes 53 to the lower three of the four internal spaces of the header 51. The refrigerant liquefied when passing through the flat perforated tubes 53 continues to exit the lower three internal spaces of the header 51, passes through the narrow tubes 57, 58, 59 to gather in the flow diverter 29, and flows to the expansion valve 33. In the operation of the air-warming cycle, the direction of refrigerant flow is reversed.

(1-3-3) Large-Diameter Tube

The large-diameter tube 30 is a cylindrical tube of larger diameter than the outdoor unit refrigerant pipes 31, and is a tube capable of accumulating excess refrigerant. The capacity of the large-diameter tube 30 is a capacity Vt.

The diameter and length of the large-diameter tube 30 are determined so that the capacity Vt, which is the capacity of the large-diameter tube 30, satisfies the following relationship formula with the capacity Vhi of the indoor heat exchanger 42, the capacity Vho of the outdoor heat exchanger 28, and the capacity Va of the accumulator 22:

$$\text{capacity } Vt > \text{capacity } Vhi - \text{capacity } Vho - \text{capacity } Va.$$

The capacity Vho of the outdoor heat exchanger 28 and the capacity Va of the accumulator 22 are both 1400 to 1600 cc, and the capacity Vt of the large-diameter tube 30 is approximately 300 cc.

The large-diameter tube 30 is provided between the outdoor heat exchanger 28 and the liquid refrigerant-side shutoff valve 37, as shown in FIGS. 1 and 5. Specifically, the large-diameter tube 30 is disposed between the outdoor heat exchanger 28 and the expansion valve 33 within the outdoor unit 20. The large-diameter tube 30 is set up so as to extend far along the vertical direction, the top end being connected to the outdoor heat exchanger 28 and the bottom end being connected to the expansion valve 33. Specifically, the large-diameter tube 30 is set up so that liquid refrigerant flows from the top downward in the pump down operation, described hereinafter. The large-diameter tube 30, which is a tube of a simple cylindrical shape, is not equipped with a gas-liquid separation function for separating the refrigerant into a gas phase and a liquid phase.

(1-3-4) Expansion Valve

The expansion valve 33 is provided to the outdoor unit refrigerant pipe 31 between the large-diameter tube 30 and the liquid refrigerant-side shutoff valve 37 in order to adjust the refrigerant pressure and/or the refrigerant flow rate, and the expansion valve has the function of expanding refrigerant in both the air-cooling operation and the air-warming operation. The expansion valve 33 is an electric valve of which the opening degree is adjusted according to a command from the controller 80.

(1-3-5) Shutoff Valves and Refrigerant Communication Pipes

The liquid refrigerant-side shutoff valve 37 and the gas refrigerant-side shutoff valve 38 are manual valves that are opened and closed manually, and are connected to the liquid refrigerant communication pipe 71 and the gas refrigerant communication pipe 72, respectively. The liquid refrigerant communication pipe 71 connects the pipe on the liquid side of the indoor heat exchanger 42 of the indoor unit 40, and the liquid refrigerant-side shutoff valve 37 of the outdoor unit 20. The gas refrigerant communication pipe 72 connects the pipe on the gas side of the indoor heat exchanger 42 of the indoor unit 40, and the gas refrigerant-side shutoff valve 38 of the outdoor unit 20.

During the air-cooling cycle, the refrigerant communication pipes 71, 72 cause refrigerant to flow sequentially through the compressor 24, the outdoor heat exchanger 28, the expansion valve 33, and the indoor heat exchanger 42, and during the air-warming cycle, the refrigerant communication pipes 71, 72 cause refrigerant to flow sequentially through the compressor 24, the indoor heat exchanger 42, the expansion valve 33, and the outdoor heat exchanger 28.

(1-4) Controller and Sensor

Figure 6:
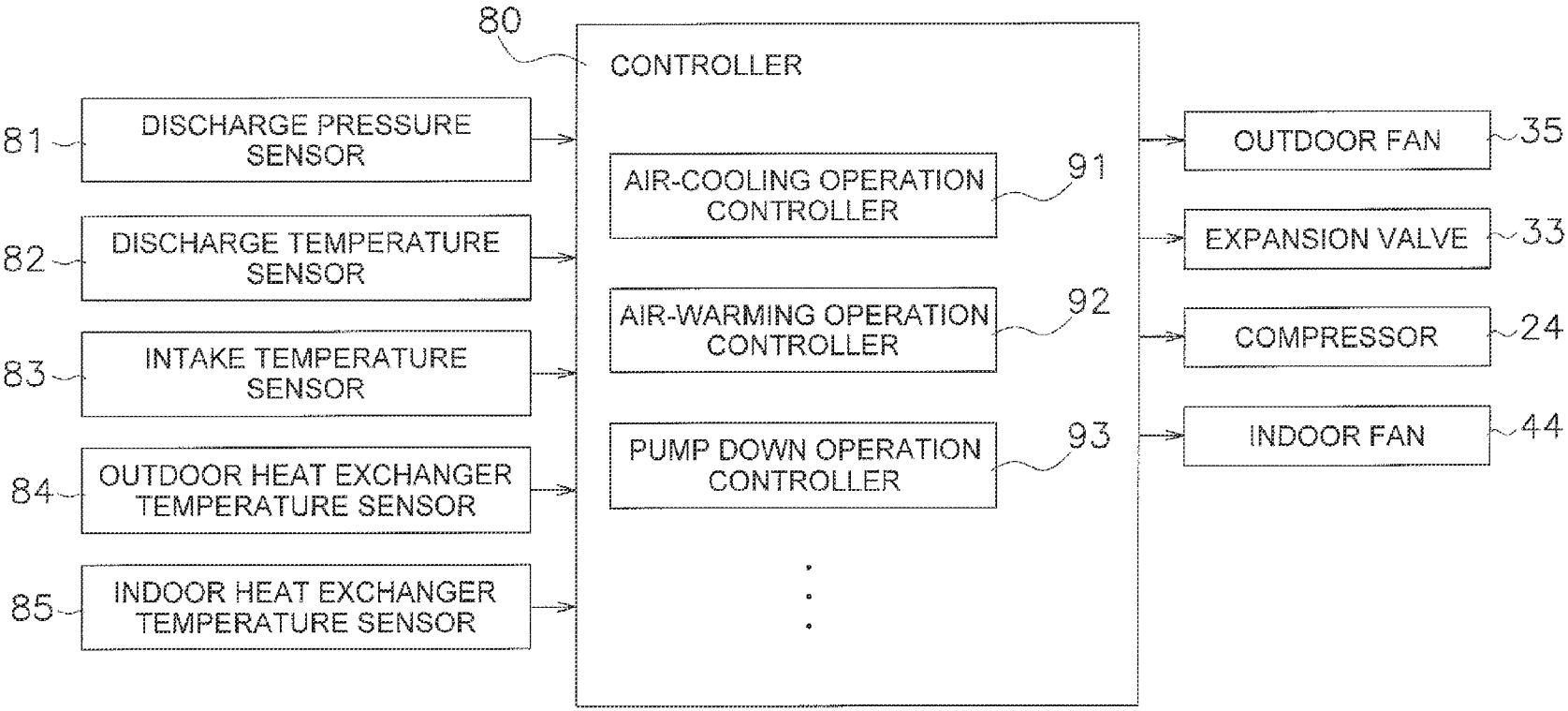
FIG. 6 is a block diagram of the controller of the air-conditioning apparatus.

The controller 80 shown in FIG. 6 is composed of a microcomputer, a memory, and the like, and in addition to executing the air-cooling operation and the air-warming operation, the controller also executes a pump down operation for collecting refrigerant in the outdoor unit 20. Therefore, the controller 80 comprises an air-cooling operation controller 91, an air-warming operation controller 92, a pump down operation controller 93, and the like as functional components.

The air-conditioning apparatus is also provided with various sensors. Specifically, the air-conditioning apparatus is provided with sensors such as a discharge pressure sensor 81 for detecting the compressor discharge pressure in the refrigerant pipe on the discharge side of the compressor 24, a discharge temperature sensor 82 for detecting the compressor discharge temperature, an intake temperature sensor 83 for detecting the temperature of refrigerant drawn into the compressor 24 in the refrigerant pipe on the intake side of the compressor 24, an outdoor heat exchanger temperature sensor 84 for detecting the temperature of refrigerant in the outdoor heat exchanger 28, and an indoor heat exchanger temperature sensor 85 for detecting the temperature of refrigerant in the indoor heat exchanger 42. The controller 80 collects various data from these sensors 81 to 85, and uses this data as information for controlling the actions of the outdoor fan 35, the expansion valve 33, the compressor 24, and the indoor fan 44 in the different operations.

(2) Refrigerant Flow During Air-Warming Operation

In FIG. 1, the four-way switching valve 26 is in the air-warming cycle state shown by the dashed lines during the air-warming operation. Specifically, the four-way switching valve 26 connects the refrigerant pipe on the discharge side of the compressor 24 and the gas refrigerant-side shutoff valve 38, and connects the refrigerant pipe on the intake side of the compressor 24 and the refrigerant pipe on the gas side of the outdoor heat exchanger 28. The opening degree of the expansion valve 33 is narrowed. As a result, the outdoor heat exchanger 28 functions as an evaporator of refrigerant, and the indoor heat exchanger 42 functions as a condenser of refrigerant.

In the refrigerant circuit in this state, low-pressure refrigerant is taken into the compressor 24, compressed to a high pressure, and then discharged. The high-pressure refrigerant discharged from the compressor 24 passes through the four-way switching valve 26, the gas refrigerant-side shutoff valve 38, and the gas refrigerant communication pipe 72, and enters the indoor heat exchanger 42. The high-pressure refrigerant that has entered the indoor heat exchanger 42 undergoes heat exchange therein with the indoor air, and the refrigerant condenses. The indoor air is thereby heated.

Because the capacity Vhi of the indoor heat exchanger 42 is greater than the capacity Vho of the outdoor heat exchanger 28, most of the liquid refrigerant is accommodated in the condenser (the indoor heat exchanger 42) during the air-warming operation. The high-pressure refrigerant condensed in the indoor heat exchanger 42 passes through the liquid refrigerant communication pipe 71 and the liquid refrigerant-side shutoff valve 37 to reach the expansion valve 33.

The refrigerant is depressurized to a low pressure by the expansion valve 33, after which the refrigerant passes through the large-diameter tube 30 and enters the outdoor heat exchanger 28. The refrigerant passing through the outdoor heat exchanger 28 undergoes heat exchange with the outdoor air supplied by the outdoor fan 35, and the refrigerant evaporates.

The low-pressure refrigerant evaporated by the outdoor heat exchanger 28 passes through the four-way switching valve 26 to again be taken into the compressor 24.

(3) Refrigerant Flow During Air-Cooling Operation and Pump Down Operation

In FIG. 1, the four-way switching valve 26 is in the air-cooling cycle state shown by the solid lines during the air-cooling operation and the pump down operation. Specifically, the four-way switching valve 26 connects the discharge side of the compressor 24 and the refrigerant pipe on the gas side of the outdoor heat exchanger 28, and also connects the refrigerant pipe on the intake side of the compressor 24 and the gas refrigerant-side shutoff valve 38. The opening degree of the expansion valve 33 is also narrowed. As a result, the outdoor heat exchanger 28 functions as a condenser of refrigerant, and the indoor heat exchanger 42 functions as an evaporator of refrigerant.

In the refrigerant circuit in this state, low-pressure refrigerant is taken into the compressor 24, compressed to a high pressure, and then discharged. The high-pressure refrigerant discharged from the compressor 24 passes through the four-way switching valve 26 to be sent to the outdoor heat exchanger 28.

The high-pressure refrigerant sent to the outdoor heat exchanger 28 undergoes heat exchange therein with the outdoor air, and the refrigerant condenses. The high-pressure refrigerant condensed in the outdoor heat exchanger 28 is sent to the expansion valve 33 via the large-diameter tube 30. Because the capacity Vho of the outdoor heat exchanger 28 is less than the capacity Vhi of the indoor heat exchanger 42, the condenser (outdoor heat exchanger 28) is unable to accommodate all of the liquid refrigerant during the air-cooling operation and the pump down operation. Therefore, during the pump down operation, liquid refrigerant that could not be accommodated in the outdoor heat exchanger 28 accumulates in the large-diameter tube 30, and the large-diameter tube 30 is filled with liquid refrigerant (see FIG. 5).

The liquid refrigerant corning out of the large-diameter tube 30 is sent to the expansion valve 33 and depressurized to a low pressure. The low-pressure refrigerant depressurized in the expansion valve 33 passes through the liquid refrigerant-side shutoff valve 37 and the liquid refrigerant communication pipe 71 and enters the indoor heat exchanger 42.

The low-pressure refrigerant that has entered the indoor heat exchanger 42 undergoes heat exchange therein with the indoor air, and the refrigerant evaporates. The indoor air is thereby cooled. The low-pressure refrigerant evaporated in the indoor heat exchanger 42 passes through the gas refrigerant communication pipe 72, the gas refrigerant-side shutoff valve 38, and the four-way switching valve 26 to again be taken into the compressor 24.

(4) Pump Down Operation

Figure 7:
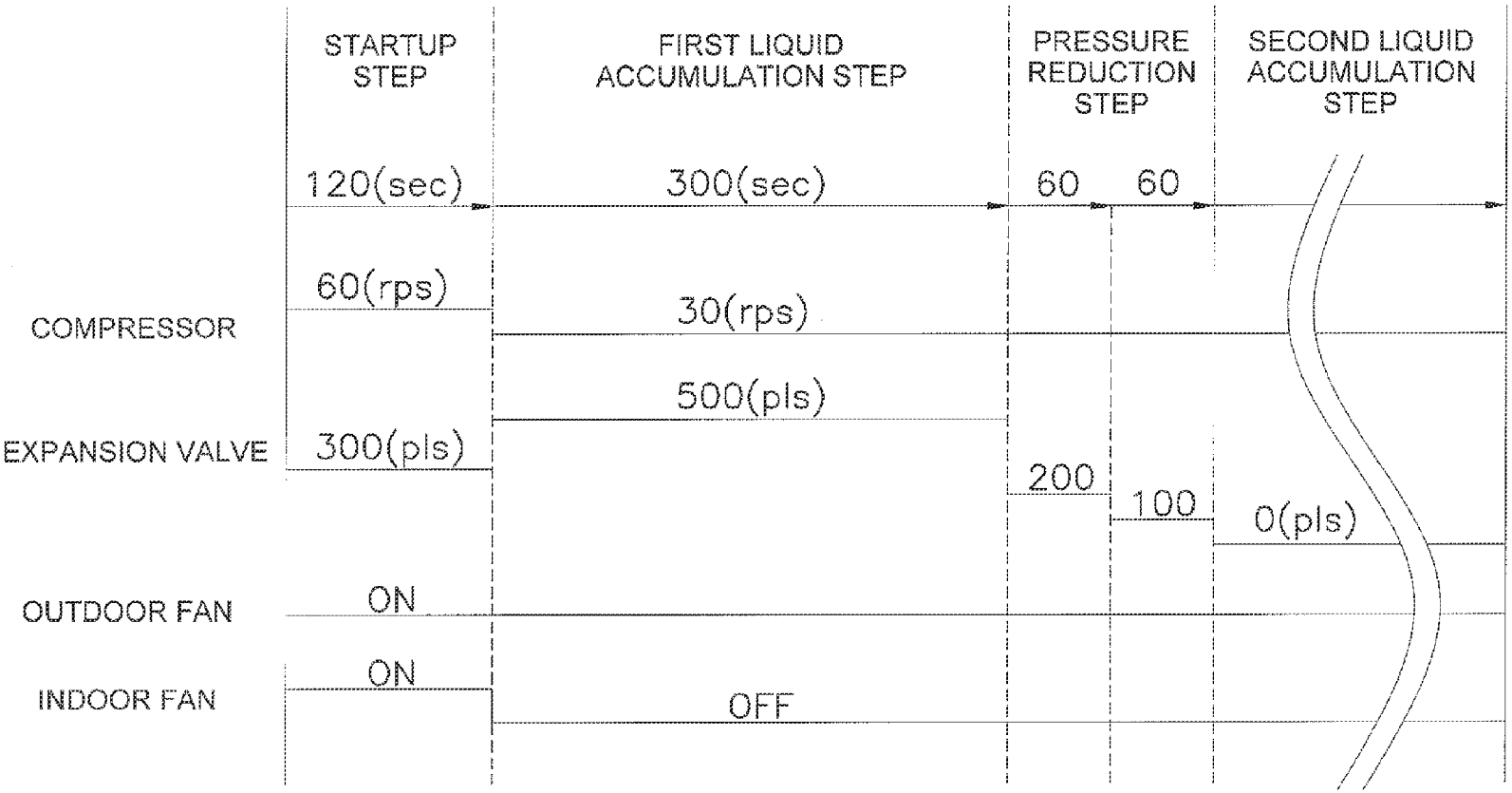
FIG. 7 is a diagram showing the controlled states and the like of the devices being controlled in each step of the pump down operation.

As described above, the pump down operation is an operation performed with the four-way switching valve 26 in the air-cooling cycle state shown by the solid lines, the same as with the air-cooling operation. The controller 80 performs the pump down operation, in which the refrigerant in the indoor unit 40 and/or the refrigerant communication pipes 71, 72 is sealed in the outdoor unit 20, in the four steps shown in FIGS. 7 and 8.

Figure 8:
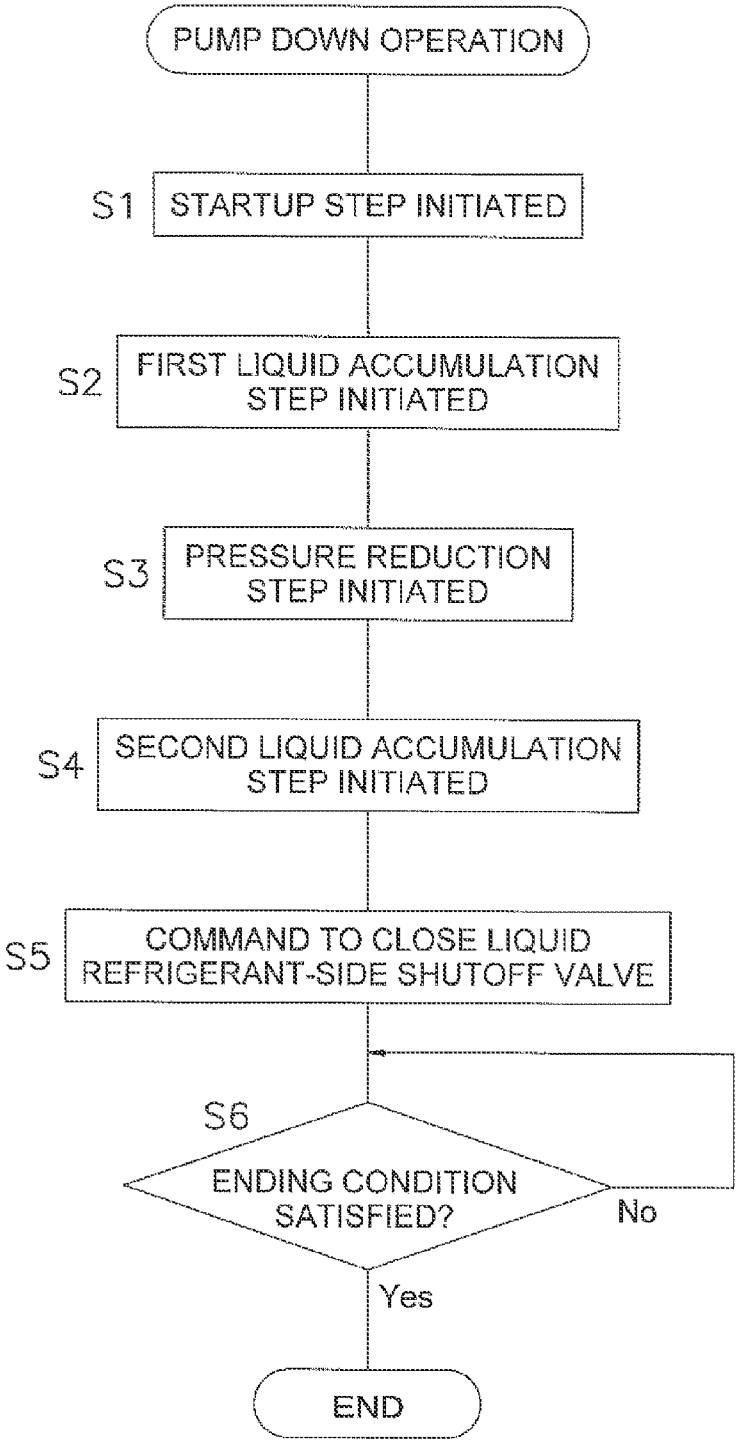
FIG. 8 is a schematic flowchart of the pump down operation.

In the pump down operation, first the startup step is initiated (step S1 in FIG. 8). In the startup step, the motor of the compressor 24 is rotated at 60 rps (60 rotations in one second), and the opening degree of the expansion valve 33 is set to 300 pls (the pulse applied to the motor for adjusting the opening degree of the expansion valve 33). The outdoor fan 35 and the indoor fan 44 are rotated at a predetermined rotational speed. As with the normal operations, the liquid refrigerant-side shutoff valve 37 and the gas refrigerant-side shutoff valve 38 at this time are in the open state.

When 120 seconds have elapsed after the initiation of the startup step, the process transitions to step S2 and the first liquid accumulation step is initiated. In the first liquid accumulation step, the motor of the compressor 24 is rotated at 30 rps, which is lower than the rotational speed of the compressor 24 during the startup step. The opening degree of the expansion valve 33 is set so as to be greater than during the startup step (500 pls in this case). The outdoor fan 35 continues to rotate at a predetermined rotational speed, but the indoor fan 44 is stopped. Because the indoor fan 44 stops, in the first liquid accumulation step humid gas refrigerant that could not evaporate in the indoor unit 40 flows to the outdoor unit 20 and separates into a gas and liquid in the accumulator 22. Of the refrigerant separated into a gas and liquid in the accumulator 22, the gas refrigerant flows to the compressor 24 and the liquid refrigerant is accumulated inside the accumulator 22.

When 300 seconds have elapsed after the initiation of the first liquid accumulation step, the process transitions to step S3 and a pressure reduction step begins. In the pressure reduction step, the rotational speed of the motor of the compressor 24 is not changed, the outdoor fan 35 continues to rotate at a predetermined rotational speed, and indoor fan 44 remains stopped. In the pressure reduction step, the opening degree of the expansion valve 33 is set to 200 pls for the first sixty seconds, and is set to 100 pls for the next sixty seconds. Thus, the opening degree of the expansion valve 33 is gradually reduced (brought nearer to a fully closed state) in the pressure reduction step, whereby the internal pressure of the accumulator 22 incrementally decreases. Foaming caused by depressurizing of the liquid refrigerant accumulated inside the accumulator 22 is thereby suppressed.

When 120-second pressure reduction step ends, the process transitions to step S4, and the second liquid accumulation step is initiated. The controller 80 changes only the opening degree of the expansion valve 33 without changing the state of the compressor 24, the outdoor fan 35, or the indoor fan 44. Specifically, the opening degree of the expansion valve 33 is set to 0 pls, and the expansion valve 33 is in a fully closed state. After the second liquid accumulation step is initiated, the controller 80 notifies the operator to close the liquid refrigerant-side shutoff valve 37. Here, an LED (not shown) that the operator can confirm is turned on, and the operator is prompted to close the liquid refrigerant-side shutoff valve 37 (step S5). The operator thereby closes the liquid refrigerant-side shutoff valve 37, and the second liquid accumulation step begins with the liquid refrigerant-side shutoff valve 37 in a closed state. Because the expansion valve 33 and/or the liquid refrigerant-side shutoff valve 37 are closed here, the refrigerant sent from the compressor 24 to the outdoor heat exchanger 28 is condensed and liquefied in the outdoor heat exchanger 28, and accumulated in the large-diameter tube 30 and/or the outdoor heat exchanger 28. FIG. 5 shows one state in which liquid refrigerant is accumulated in the large-diameter tube 30 and/or the outdoor heat exchanger 28.

In step S6, a determination is made as to whether or not the condition for ending the second liquid accumulation step is satisfied. The condition used herein for the ending condition is that the refrigerant temperature in the discharge side of the compressor 24 be a predetermined temperature or higher. Other options for this ending condition are that a predetermined time duration have lapsed since the initiation of the second liquid accumulation step, or that the refrigerant temperature in the intake side of the compressor 24 be a predetermined temperature or lower.

(5) Characteristics of Air-Conditioning Apparatus (5-1)

In this air-conditioning apparatus, the capacity Vhi of the indoor heat exchanger is greater than the capacity Vho of the outdoor heat exchanger, but the outdoor unit 20 comprises a large-diameter tube 30 not found in conventional apparatuses. The capacity Vt of the large-diameter tube 30 is greater than the capacity resulting from subtracting the capacity Vho of the outdoor heat exchanger 28 and the capacity Va of the accumulator 22 from the capacity Vhi of the indoor heat exchanger 42. Specifically, the diameter and length of the large-diameter tube 30 are determined so that the formula:

$$\text{capacity } Vt > \text{capacity } Vhi - \text{capacity } Vho - \text{capacity}$$

is satisfied.

It is thereby possible for refrigerant to be suitably collected in the outdoor unit 20 by the pump down operation.

(5-2)

In this air-conditioning apparatus, the accumulator 22, which is also found in conventional apparatuses, is given the same gas-liquid separation function as in conventional practice, but the large-diameter tube 30 is not given a gas-liquid separation function. The large-diameter tube 30, which is a tube of a simple cylindrical shape, can be manufactured and assembled at low cost, and cost increases of the air-conditioning apparatus can therefore be kept low.

The large-diameter tube 30 is also set up so as to extend far along the vertical direction, the top end being connected to the outdoor heat exchanger 28 and the bottom end being connected to the expansion valve 33. Liquid refrigerant thereby flows from the top of the large-diameter tube 30 downward in the pump down operation, and liquid refrigerant readily accumulates in the internal space of the large-diameter tube 30.

(5-3)

In this air-conditioning apparatus, the large-diameter tube 30 is set up between the outdoor heat exchanger 28 and the expansion valve 33, and the expansion valve 33 is fully closed at the initiation of the second liquid accumulation step of the pump down operation. Therefore, during the second liquid accumulation step, liquid refrigerant starts accumulating in the large-diameter tube 30 and the outdoor heat exchanger 28 before the operator closes the liquid refrigerant-side shutoff valve 37. The time of the pump down operation is thereby shortened.

(5-4)

When refrigerant is collected in the outdoor unit by the pump down operation, in a conventional apparatus, refrigerant would be sent from the compressor to the outdoor heat exchanger with the liquid refrigerant-side shutoff valve in a closed state, and the refrigerant would accumulate in the outdoor heat exchanger, but the liquid refrigerant would for the most part not accumulate in an accumulator provided to the pipe on the intake side of the compressor.

In this air-conditioning apparatus, the first liquid accumulation step of accumulating refrigerant in the accumulator 22 is performed before the second liquid accumulation step, which is performed with the liquid refrigerant-side shutoff valve 37 in a closed state. Thus, in the pump down operation, refrigerant is caused to accumulate in the different parts of the outdoor unit 20 sequentially in the first liquid accumulation step in which the liquid refrigerant-side shutoff valve 37 is opened and humid gas refrigerant is drawn out of the indoor heat exchanger 42, and the second liquid accumulation step in which the liquid refrigerant-side shutoff valve 37 is closed and refrigerant is sent to the outdoor heat exchanger 28. It is therefore possible to avoid circumstances in which refrigerant cannot be accommodated in the outdoor unit 20.

(5-5)

In this air-conditioning apparatus, in the pump down operation, the controller 80 executes the pressure reduction step after the first liquid accumulation step and before the second liquid accumulation step. In the pressure reduction step, the refrigerant pressure inside the accumulator 22 is incrementally lowered by varying the opening degree of the expansion valve 33.

If the first liquid accumulation step were to suddenly transition to the second liquid accumulation step in which the liquid refrigerant-side shutoff valve 37 is closed, the liquid refrigerant accumulated in the accumulator 22 would be at risk of foaming caused by depressurizing.

However, because the pressure reduction step is provided between the first liquid accumulation step and the second liquid accumulation step herein, there is virtually little foaming of the liquid refrigerant in the accumulator 22 that had accumulated in the first liquid accumulation step and little loss of the refrigerant in the accumulator 22.

(5-6)

In this air-conditioning apparatus, when the second liquid accumulation step is initiated, the controller 80 brings the opening degree of the expansion valve 33 to a lower limit value and brings the expansion valve 33 to a fully closed state. Furthermore, the controller 80 notifies the operator to close the liquid refrigerant-side shutoff valve 37 so that the action of closing the liquid refrigerant-side shutoff valve 37 is performed after the opening degree of the expansion valve 33 has reached the lower limit value.

The refrigerant sent from the compressor 24 to the outdoor heat exchanger 28 thereby does not flow to the indoor unit 40 in the second liquid accumulation step, even before the liquid refrigerant-side shutoff valve 37 is closed. The timing of the notification prompting to close the liquid refrigerant-side shutoff valve 37 is set to a timing such that the action of manually closing the liquid refrigerant-side shutoff valve 37 is performed after the expansion valve 33 has fully closed. Therefore, circumstances are avoided in which the liquid refrigerant-side shutoff valve 37 is closed manually before the expansion valve 33 is fully closed, and there is suitable effect of the foaming suppression function of the pressure reduction step.

(5-7)

In this air-conditioning apparatus, the pressure reduction step is provided in order to suppress foaming caused by depressurizing in the accumulator 22, but if too much time is taken for the pressure reduction step, the total time duration needed for the pump down operation will run long. In view of this, the controller 80 of the air-conditioning apparatus ends the pressure reduction step after a predetermined time duration (120 seconds) has elapsed. It is thereby possible to avoid circumstances in which the time duration of the pressure reduction step runs long.

(5-8)

In the first liquid accumulation step, humid gas refrigerant is drawn out from the indoor heat exchanger 42 with the liquid refrigerant-side shutoff valve 37 and/or the expansion valve 33 in an open state and the refrigerant is accumulated in the accumulator 22, but when this drawing out of humid gas refrigerant is continued for a long time, liquid refrigerant that cannot be accumulated in the accumulator 22 is at risk of flowing to the compressor 24.

In view of this, in this air-conditioning apparatus, the controller 80 ends the first liquid accumulation step after a predetermined time duration (300 seconds) has elapsed. 300 seconds is a time duration found in advance by testing to be the time duration taken for the refrigerant to accumulate in the accumulator 22, and is the time duration incorporated into the controller 80. It is thereby possible to avoid failures in which liquid refrigerant flows from the accumulator 22 to the compressor 24 and the compressor 24 is damaged in the pump down operation.

Regarding the predetermined time duration for ending the first liquid accumulation step, the suitable time duration changes depending on the configuration of the air-conditioning apparatus.

(5-9)

Before performing the first liquid accumulation step which is different from the normal operation of drawing humid gas refrigerant out from the indoor heat exchanger 42, the controller 80 of this air-conditioning apparatus executes the startup step of operating the compressor 24 at a rotational speed (60 rps) higher than the rotational speed (30 rps) of the compressor 24 in the first liquid accumulation step. This startup step, which is similar to the normal operation, is performed first in the pump down operation, the behavior of the refrigerant in the first liquid accumulation step therefore stabilizes, and the steps following the first liquid accumulation step are executed satisfactorily with little effect from the states of the air-conditioning apparatus and the refrigerant prior to the pump down operation.

(6) Modifications (6-1)

In the above embodiment, the pressure reduction step is ended after the predetermined time duration (120 seconds) has elapsed, but the following can also be done in order to shorten the time duration needed for the pressure reduction step.

In this modification, a new intake pressure sensor is provided to the refrigerant pipe on the intake side of the compressor 24, and based on the value outputted by this intake pressure sensor, assessments are made for varying the opening degree of the expansion valve 33 in the pressure reduction step, and also for ending the pressure reduction step. In this case, based on the value outputted by the intake pressure sensor which comes to show the internal pressure of the accumulator 22, the opening degree of the expansion valve 33 is incrementally reduced so that there is no foaming caused by depressurizing of the liquid refrigerant in the accumulator 22. When the value of the intake pressure sensor is low enough that there is no foaming caused by depressurizing even when the opening degree of the expansion valve 33 is fully closed, the pressure reduction step is ended and the second liquid accumulation step is begun. It is thereby possible, although a new intake pressure sensor is needed, to shorten the time duration needed for the pressure reduction step.

(6-2)

In the above embodiment, the notification prompting the operator to close the liquid refrigerant-side shutoff valve 37 after starting the second liquid accumulation step is performed by an LED (not shown) turning on, but a display may be used if there is one provided, or another notification means may be used if such means are provided.

(6-3)

In the above embodiment, a stacked heat exchanger having flat perforated tubes 53, inserted fins 54, and headers 51, 52 is used as the outdoor heat exchanger 28, but a stacked heat exchanger having another structure can also be used.

Figure 9:
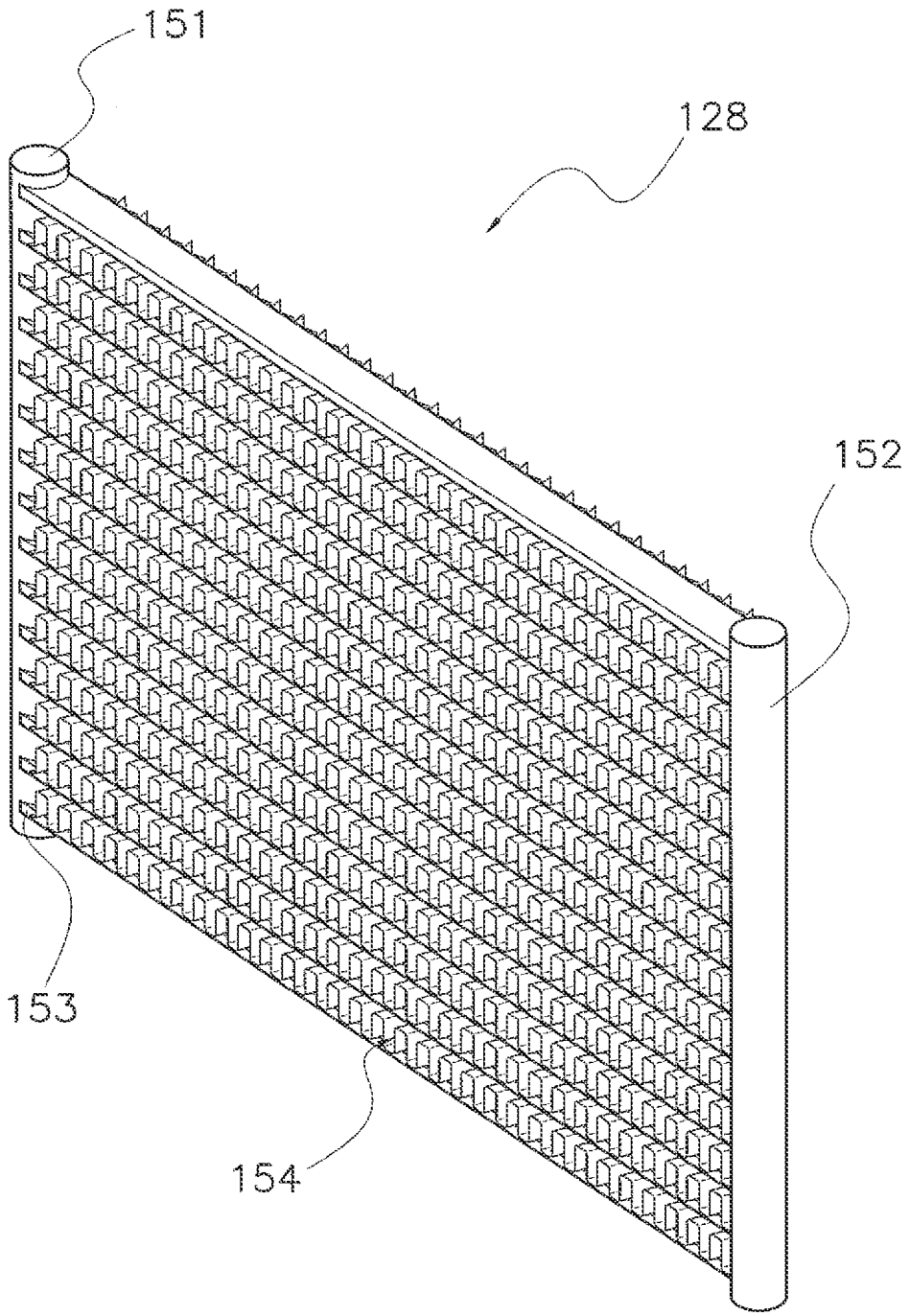
FIG. 9 is a perspective view of an outdoor heat exchanger according to a modification.

For example, the heat exchanger may be the heat exchanger 128 shown in FIG. 9, having flat perforated tubes 153, corrugated fins 154, and headers 151, 152. The corrugated fins 154 are fins made of aluminum or an aluminum alloy, folded into corrugations. The corrugated fins 154 are disposed in the air passage spaces enclosed between vertically adjacent flat perforated tubes 153, and the furrows and ridges of the fins are in contact with the flat surfaces of the flat perforated tubes 153.

What is claimed is:

1. A refrigeration apparatus comprising:

a heat source-side unit having a refrigerant container, a compressor, a heat source-side heat exchanger; an expansion valve; a large-diameter tube; a liquid refrigerant-side shutoff valve, and a gas refrigerant-side shutoff valve, which are joined together by refrigerant pipes;

a usage-side unit having a usage-side heat exchanger joined at one end to the liquid refrigerant-side shutoff valve via a liquid refrigerant communication pipe and joined at an other end to the gas refrigerant-side shutoff valve via a gas refrigerant communication pipe; and a controller configured to execute a pump down operation in order to collect refrigerant in the heat source-side unit, the refrigerant container having a capacity Va, the heat source-side heat exchanger having a capacity Vho, the usage-side heat exchanger having a capacity Vhi, with the capacity Vhi being greater than the capacity Vho, the large-diameter tube having a larger diameter than the refrigerant pipes of the heat source-side unit, the large-diameter tube being configured to accumulate excess refrigerant, and the large diameter tube being provided between the heat source-side heat exchanger and the liquid refrigerant-side shutoff valve so that a capacity Vt of the large-diameter tube satisfies:

$$\text{capacity } Vt > \text{capacity } Vhi - \text{capacity } Vho - \text{capacity } Va > 0, \text{ and}$$

the larger-diameter tube including two ends in a longitudinal direction thereof, with one of the two ends being positioned on a liquid side of the heat source-side heat exchanger in the heat source-side unit.

2. The refrigeration apparatus according to claim 1, wherein the heat source-side heat exchanger is a stacked heat exchanger having a plurality of flat tubes arrayed at intervals, and heat transfer fins in contact with the flat tubes.

3. The refrigeration apparatus according to claim 1, wherein the refrigerant container is equipped with a gas-liquid separation function, and the large-diameter tube is not equipped with a gas-liquid separation function.

4. The refrigeration apparatus according to claim 1, wherein the large-diameter tube is set up so that refrigerant flows from a top downward when the pump down operation is executed.

5. The refrigeration apparatus according to claim 1, wherein the expansion valve is an electric valve disposed between the heat source-side heat exchanger and the liquid refrigerant-side shutoff valve, and the large-diameter tube is disposed between the heat source-side heat exchanger and the expansion valve.

6. The refrigeration apparatus according to claim 1, wherein the refrigerant container is an accumulator provided to the refrigerant pipe on an intake side of the compressor, and when the pump down operation is executed, the controller executes a first liquid accumulation step before a second liquid accumulation step, the liquid refrigerant-side shutoff valve being opened, humid gas refrigerant being drawn out of the usage-side heat exchanger via the gas refrigerant communication pipe, and refrigerant being accumulated in the refrigerant container when first liquid accumulation step is executed, and the liquid refrigerant-side shutoff valve being closed, refrigerant being sent from the compressor to the heat source-side heat exchanger, and refrigerant being accumulated in the large-diameter tube and the heat source-side heat exchanger when the second liquid accumulation step is executed.

* * * * *